US006530848B2

(12) United States Patent
Gillig

(10) Patent No.: US 6,530,848 B2
(45) Date of Patent: Mar. 11, 2003

(54) MULTIPURPOSE GOLF CLUB

(75) Inventor: John P. Gillig, Margate, FL (US)

(73) Assignee: Elizabeth P. Gillig, Duxbury, MA (US)

( * ) Notice: Subject to any disclaimer, the term of this patent is extended or adjusted under 35 U.S.C. 154(b) by 0 days.

(21) Appl. No.: 09/849,522

(22) Filed: May 7, 2001

(65) Prior Publication Data

US 2001/0039218 A1 Nov. 8, 2001

Related U.S. Application Data

(60) Provisional application No. 60/205,250, filed on May 19, 2000.

(51) Int. Cl.[7] ..... A63B 53/04; A63B 53/06

(52) U.S. Cl. ..... 473/334; 473/345; 473/349; 473/350

(58) Field of Search ..... 473/324, 334, 473/327, 328, 338, 340, 341, 349, 350, 286, 345, 346, 291; D21/733, 752, 748, 736

(56) References Cited

U.S. PATENT DOCUMENTS

| | | | | |
|---|---|---|---|---|
| 777,400 | A | * | 12/1904 | Clark |
| 1,960,110 | A | * | 5/1934 | Iles |
| 2,056,335 | A | * | 10/1936 | Wettlaufer |
| 3,841,640 | A | * | 10/1974 | Gaulocher |
| D239,187 | S | * | 3/1976 | Smith |
| 4,043,563 | A | | 8/1977 | Churchward |
| 4,085,934 | A | | 4/1978 | Churchward |
| 4,340,230 | A | | 7/1982 | Churchward |
| 4,431,192 | A | * | 2/1984 | Stuff |
| D285,231 | S | * | 8/1986 | Solomon |
| 4,618,149 | A | | 10/1986 | Maxel |
| 4,655,459 | A | * | 4/1987 | Antonious |
| 4,730,830 | A | | 3/1988 | Tilley |
| 4,900,029 | A | * | 2/1990 | Sinclair |
| D318,701 | S | * | 7/1991 | Antonious |
| 5,060,949 | A | * | 10/1991 | Brill |
| 5,429,354 | A | * | 7/1995 | Long |
| 5,441,274 | A | | 8/1995 | Clay |
| 5,474,297 | A | * | 12/1995 | Levin |
| 5,533,725 | A | | 7/1996 | Reynolds, Jr. |
| 5,683,307 | A | * | 11/1997 | Rife |
| 5,746,664 | A | | 5/1998 | Reynolds, Jr. |
| 5,871,407 | A | * | 2/1999 | Tseng |
| 5,997,415 | A | * | 12/1999 | Wood |
| 6,017,280 | A | * | 1/2000 | Hubert |
| 6,033,318 | A | * | 3/2000 | Drajan |
| 6,059,669 | A | * | 5/2000 | Pearce |
| D447,201 | S | * | 8/2001 | Boyd |
| 6,280,349 | B1 | * | 8/2001 | Cook |

FOREIGN PATENT DOCUMENTS

| | | |
|---|---|---|
| GB | 317502 | 4/1931 |

* cited by examiner

*Primary Examiner*—Sebastiano Passaniti
(74) *Attorney, Agent, or Firm*—Richard C. Litman

(57) ABSTRACT

A golf club is modified by substantially hollowing out the entire portion or a predominant portion of the club head before purchase. The placement of the position of the weight can now be placed to increase or decrease clockwise spin, counter-clockwise spin, and backspin of the golf ball propelled by the club. If the purchaser's golf swing changes, the golfer can get fitted for a new sole plate insert to adjust the weight to achieve a more desirable ball spin for an improved flight of the golf ball.

9 Claims, 4 Drawing Sheets

MULTIPURPOSE GOLF CLUB

CROSS-REFERENCE TO RELATED APPLICATION

This application claims the benefit of U.S. Provisional Patent Application Ser. No. 60/205,250, filed May 19, 2000.

BACKGROUND OF THE INVENTION

1. Field of the Invention

The present invention relates generally to golf clubs. More specifically, the invention is the weight modification of a golf club head by hollowing out a portion of the club head, which may be made of wood, plastic or metal, or other materials, and providing a novel weighted sole plate.

2. Description of Related Art

The related art of interest describes various weight modified golf clubs, but none discloses the present invention. There is a need for a simplified method of determining and selecting the best weight of the club head for certain conditions, distances and for a specific golfer. The related art will be discussed in the order of perceived relevance to the present invention.

U.S. Pat. No. 5,441,274 issued on Aug. 15, 1995, to Truman R. Clay describes a putter adjustable in weight and shaft position comprising a rectangular club head having a rectangular hole on top with a smaller opening on the bottom. The hole is filled on the bottom with a lower part insert having inclined stepped ramps proximate each end to match the stepped overhang ramps of the T-shaped upper part insert. Each insert part has bores for adding weight slugs. The upper part insert has two covers and an inclined bore for the shaft which can be shifted in position by moving the upper insert relative to the lower insert. The grip has a club attitude index. The putter is distinguishable for the required multiple insertion parts and weight slugs.

Gt. Britain Patent Application No. 347,502 published on Apr. 30, 1931, for James G. Gill describes a wooden club head bored through the middle and lined with a metal sleeve which is filled with lead shot separated by a felt pad from a cylindrical block of sponge rubber having another felt pad. The filler material is capped with a slotted and screwed plug. The metal sleeve is anchored by two metal pins driven from the bottom surface at an angle. The metal sole plate is sunk into the bottom surface and fastened by five screws. The weighted club head is distinguishable for its requirement for lead weights, anchor pins, metal liner, and a metal top plug.

U.S. Pat. No. 4,618,149 issued on Oct. 21, 1986, to John M. Maxel describes a golf club having interchangeable face plates to vary the characteristics of a curved bulge from toe to heel, a curved roll from bottom to top and a degree of angular loft. The wood club head is hollowed from the face plate and either a central rib with a cylindrical weight is inserted or a planar weight is added to the rear of the face plate. The golf club is distinguishable for hollowing the club head only from the face plate.

U.S. Pat. No. 4,730,830 issued on Mar. 15, 1988, to Gordon J. Tilley describes a golf club with a hollow head filled with injected foam from the face plate and covered with a face plate made from woven Kevlar impregnated with an epoxy resin and backed by a carbon fiber layer. A second embodiment requires an array of blind bores formed from the face plate side and filled with weights. The weighted golf clubs are distinguishable for forming the cavity from the face plate.

U.S. Pat. No. 4,085,934 issued on Apr. 25, 1978, to Roy A. Churchward describes a weighted impact block for adding to the face of a wooden, plastic or nylon club head. The club head has a hollowed out portion on the bottom which is covered by a sole plate fastened with screws to an inlet periphery. On the rear of the sole plate one or two impact blocks having an array of holes receive rod shaped weights. The golf club is distinguishable for its required weight blocks.

U.S. Pat. No. 4,043,563 issued on Aug. 23, 1977, to Roy A. Churchward describes a weighted golf club having a similar impact block with rod shaped weights as in the above patent but placed in a hollowed region from the sole plate. The golf club is distinguishable for its required weight containing impact block.

U.S. Pat. No. 4,340,230 issued on Jul. 20, 1982, to Roy A. Churchward describes a weighted pitching or sand wedge golf club. The thickened matrix portion of the iron club head has a row of blind bores for inserting rod shaped weights and covering with a cap secured by a fastener. The golf club is distinguishable for its required weights.

U.S. Pat. No. 5,533,725 issued on Jul. 9, 1996, to Walker Reynolds, Jr. describes a weighted golf putter having a U-shaped club head with spool shaped weights inserted in each end from a top surface and secured by a fastener from the bottom of the putter head. The shaft is secured by a set screw. The golf club is distinguishable for its dual weights.

U.S. Pat. No. 5,746,664 issued on May 5, 1998, to Walker Reynolds, Jr. describes a weighted golf putter comprising a weighted shaft grip and a substantially rectangular box shaped club head having two spool shaped weights and a third weight inserted between and perpendicular to the spools. The golf putter is distinguishable for its multiple weights in the handle and club head.

None of the above inventions and patents, taken either singly or in combination, is seen to describe the instant invention as claimed.

SUMMARY OF THE INVENTION

A golf club head made of wooden, plastic, metal, and other suitable materials is modified to decrease its weight by hollowing out the club head and providing replaceable, weighted sole plate(s). The sole plate may be uniformly or variably weighted from club hosel end to toe end, and may include a weight of uniform or non-uniform weight distribution, which is mounted or made a part of the interior of the sole plate, and the weight is placed up against the interior of the club face.

Accordingly, it is a principal object of the invention to provide a wooden, plastic or metal golf club having a weight modified club head, provided by an interchangeable sole plate.

It is another object of the invention to provide a wooden, plastic or metal golf club having a club head with a hollowed out portion.

It is a further object of the invention to provide a golf club having a club head with a hollowed portion made during production according to the golfer's preference, and further providing a modified sole plate, with or without and additional, integral or added weight, fitted in behind the face plate of the club.

It is still another object of the invention to provide a golf club head, modified with a hollowed out interior and fitted with a uniformly weighted or non-uniformly weighted, novel sole plate construction, the sole plate being interchangeable to suit a particular golfer's needs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a golf club having a club head adjusted in weight according to the preference of a golfer. A golf club is modified either before or after purchase by replacing an interchangeable weighted sole plate for the club head. The golfer can then select the best weight and the placement of weight for one's game. Since the club head is open, additional weight can be added in any formation or in any area without adding a cover.

Figure 1:
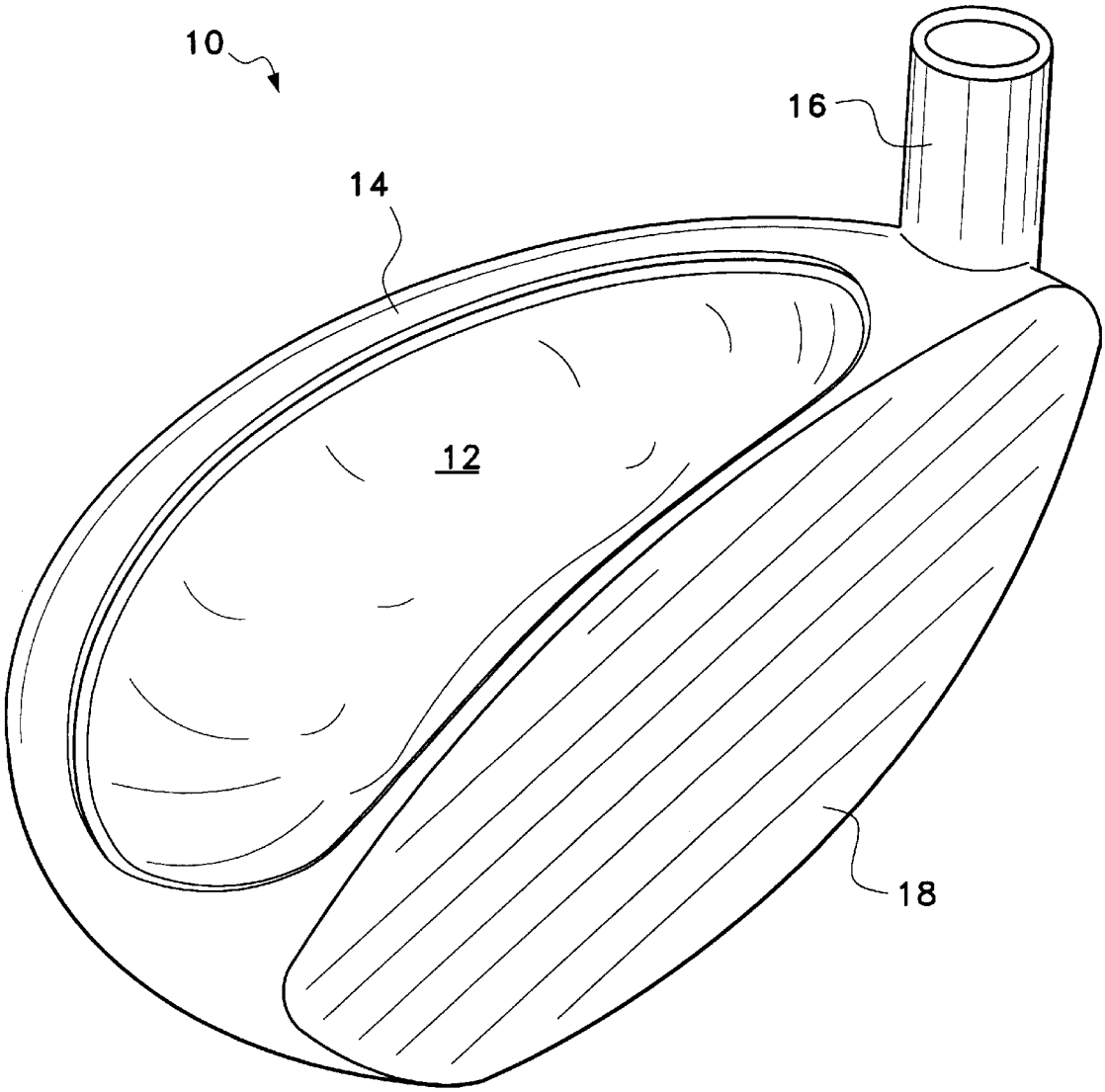
FIG. 1 is a perspective view of a first embodiment of a multipurpose golf club head with a hollow portion according to the present invention.

A first embodiment of the present invention is illustrated in FIG. 1, wherein a metal, plastic or the like driver club head 10 has a hollowed out portion 12 made from the top surface 14 adjacent the hosel 16 and the face plate 18. The selection of the sole plate 24 weight system adjusts the weight of the club to the player. This selection can be determined by trying a sample club.

Figure 2:
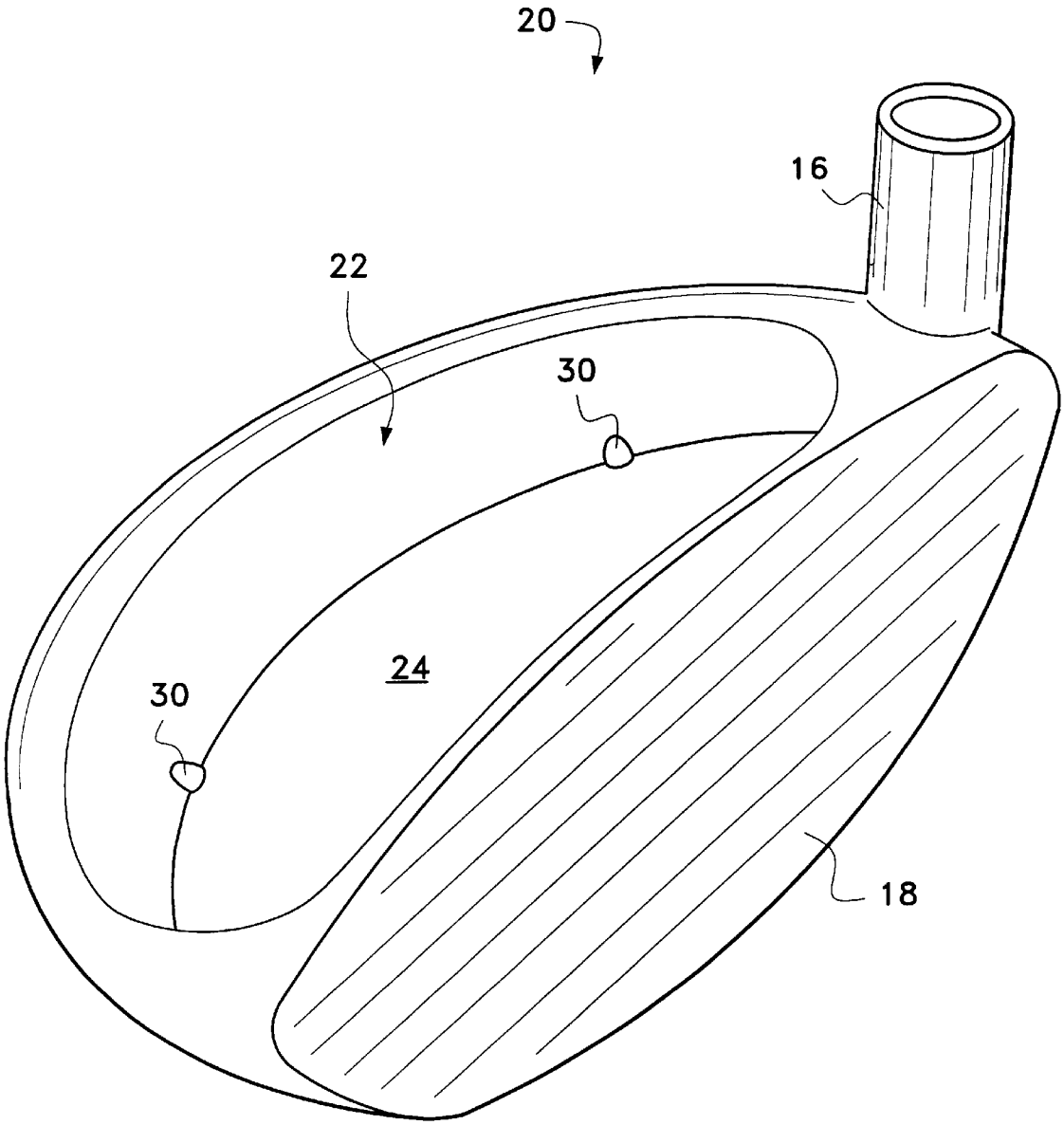
FIG. 2 is a top perspective view of a second embodiment of the multipurpose golf club head having a hole with a retaining ledge and omitting the sole plate.
Figure 3:
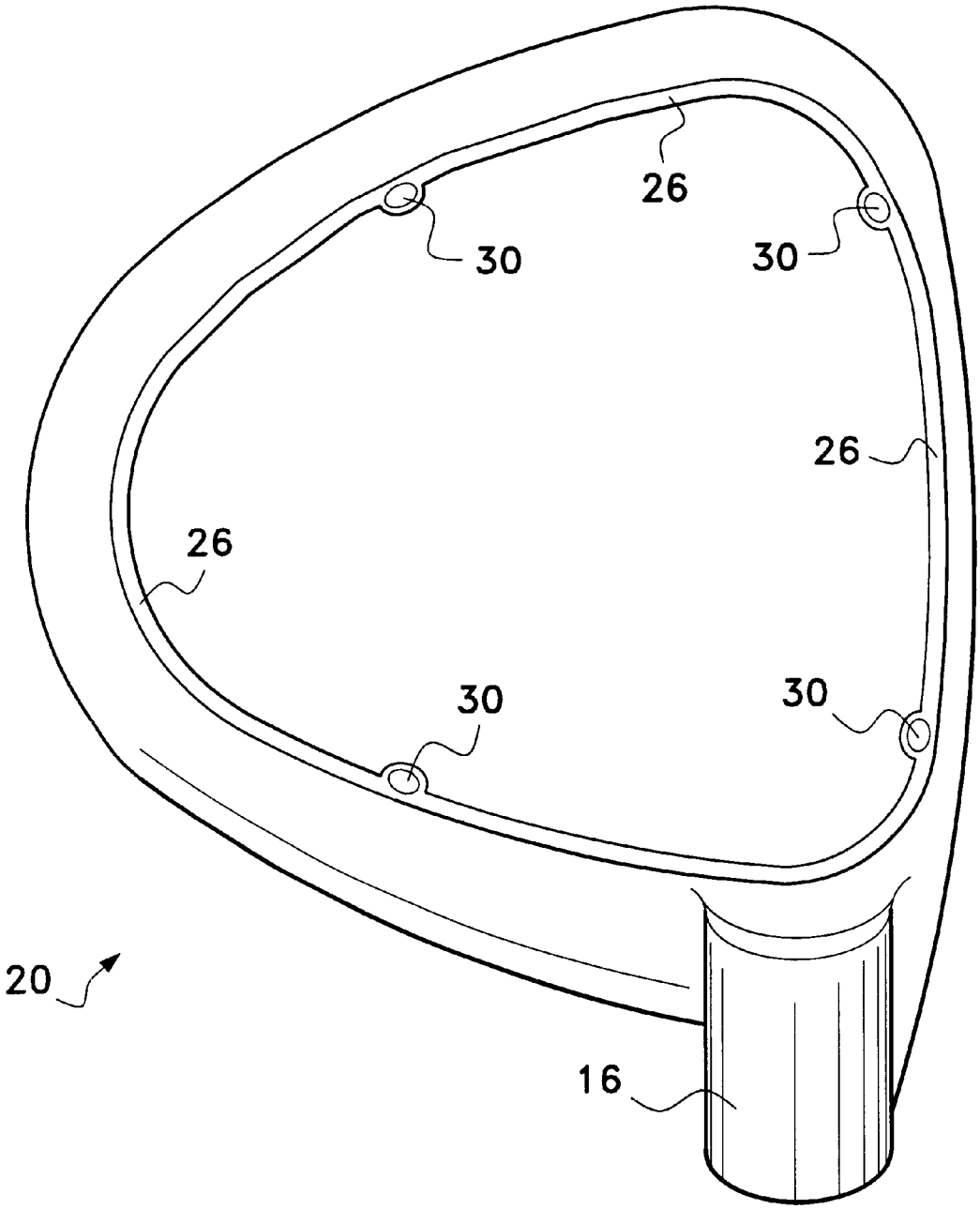
FIG. 3 is a bottom perspective view of the multipurpose golf club head of FIG. 2 embodiment showing the apertured retaining ledge for replacing the sole plate.
Figure 4:
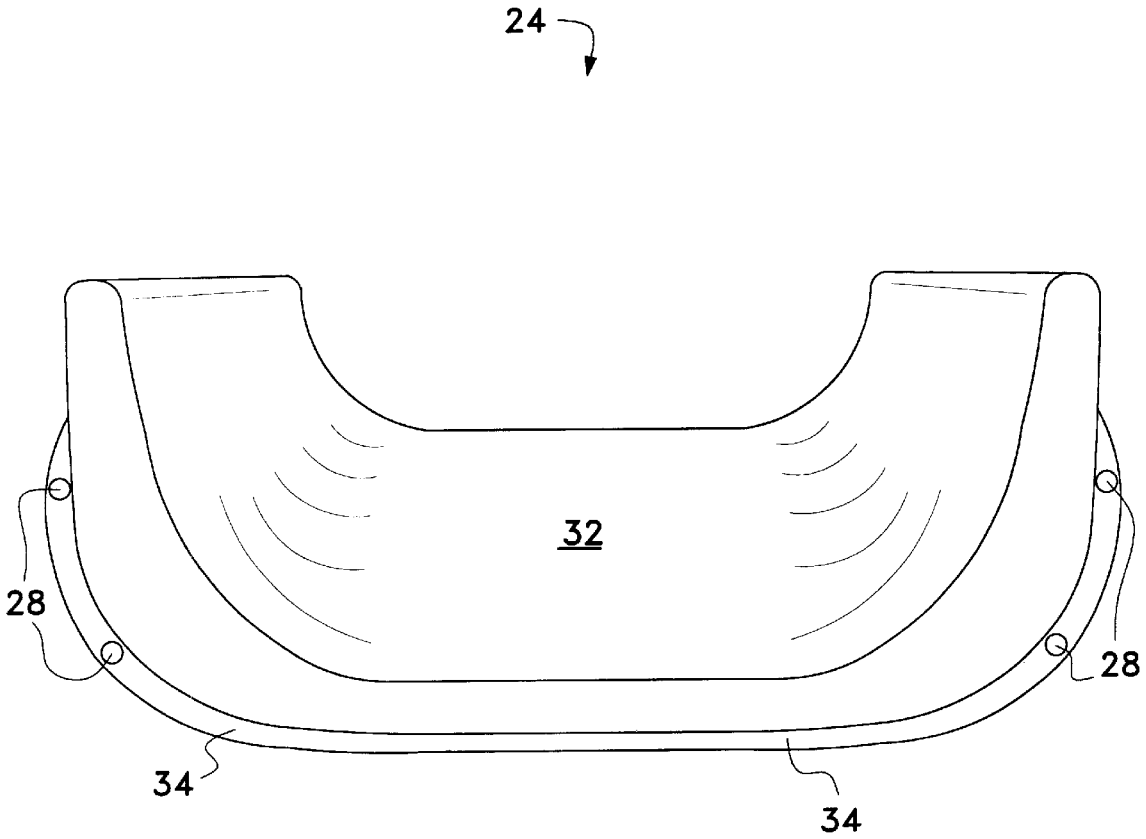
FIG. 4 is a front elevational view of an interchangeable sole plate made with a concave weight configuration.

In FIGS. 2, 3 and 4, a second embodiment of a modified golf club head 20 is illustrated, wherein a hollow portion 22 is a hole made completely through the club head adjacent the face plate 18 and an open area ordinarily closed by a pre-existing sole plate(not shown). Instead, the conventional sole plate is replaced by the sole plate 24 of this invention (FIG. 4). An inlet ledge 26 (FIG. 3) with a plurality of apertures or screw holes 30 is provided for attaching the sole plate 24 of this invention. The inlet ledge 26 can be reinforced with a metal or plastic gasket (not shown).

FIG. 4 illustrates the sole plate 24 having an inner concave surfaced weight 32 as viewed from above. The sole plate 24 has a rim 34 which matches the ledge 26 shown in FIG. 3. Four apertures 28 are formed through rim 34, and these match up with the screw holes 30 of the club head (FIG. 3). Now, with reference to FIGS. 3 and 4, the sole plate as seen in FIG. 4 is inverted and rotated 90°, and then placed with rim 34 on top of ledge 26 as seen in FIG. 3. Thereafter, screw fasteners (not shown) are inserted through apertures 28 and threaded into holes 30 to mount the sole plate 24 in place. Thus, the weight 32 will be placed up against and behind the face plate 18.

Sometimes a third embodiment can be used (which does not require a drawing) by shifting of the weight of the sole plate 24 from heel to toe by utilizing a metal plate made by adjusting the relative proportions in terms of volume and area of tungsten and the lighter titanium and the like metals. Alternatively, the thickness of a metal or plastic sole plate can be varied to adjust the desired weight. Thus, it can be appreciated that the sole plate may be provided with the extra weight 32 in some instances, and in others, it may not be needed at all. Thus, a wide variety of weight adjusting techniques are provided by the instant invention, and none involve any modification of the face plate 18 at all. The sole plate may vary in composition/thickness, and thus weight, or an additional weight (usually integral) may be provided, or a combination of the two techniques may be employed to produce a club satisfactory for the user.

As noted earlier, the club head can be made of various materials such as metal, epoxy, fiberglass, and wood. Although the example has been shown for a club head with a bulky body, it is contemplated that this invention can be applied equally to all clubs, from a driver to a sand iron, putter, and utility clubs with smaller bodies.

Thus, a simple economical method of adjusting the weight of a golf club head has been shown which does not require the insertion and covering of cumbersome weight pieces and the like to adjust the desired club head weight. Also, the face plate of the club is not changed in any way with the present invention.

It is to be understood that the present invention is not limited to the embodiments described above, but encompasses any and all embodiments within the scope of the following claims.

I claim:

1. An adjustable weighted golf club comprising:

a club head having a flat face plate and a hosel adjacent said face plate for accepting a shaft, said club head further including a hollowed out body portion having a bottom surface and defining an exposed, substantially concave top surface extending rearward of said face plate;

a plurality of interchangeable sole plates of varying weights, each of said plates being removably securable to the bottom surface of said hollowed out body portion; and means for removably securing one of said plurality of sole plates to said club head; whereby an individual golfer may adjust the total weight of the club head by selecting one of the sole plates of a fixed weight.

2. The golf club according to claim 1, wherein the bottom surface of said hollowed out body portion includes a peripheral ledge having a plurality of apertures.

3. The golf club according to claim 2, wherein each of said plurality of interchangeable sole plates includes a rim having a plurality of apertures and is configured to correspond to the peripheral ledge of said hollowed out body portion.

4. The golf club according to claim 3, wherein said removably securing means includes screws passing through the apertures of one of said plurality of sole plates and the apertures in the peripheral ledge of said hollowed out body portion.

5. The golf club according to claim 1, wherein said plurality of sole plates are made of a metal composition.

6. The golf club according to claim 5, wherein said metal composition is a mixture of tungsten and titanium.

7. The golf club according to claim 5, wherein said plurality of sole plates vary in thickness.

8. The golf club according to claim 1, wherein said golf club is selected from a group consisting of a driver, a sand iron, a putter, and an utility club.

9. The golf club according to claim 1, wherein said club head is fabricated from a material selected from a group consisting of wood, plastic and metal.

* * * * *